US009091286B2

(12) United States Patent
Cesur et al.

(10) Patent No.: US 9,091,286 B2
(45) Date of Patent: Jul. 28, 2015

(54) HYDRAULIC CONTROL SYSTEM HAVING ELECTRONIC FLOW LIMITING

(71) Applicant: Caterpillar Inc., Peoria, IL (US)

(72) Inventors: Rustu Cesur, Lombard, IL (US); Jiao Zhang, Naperville, IL (US); Tonglin Shang, Bolingbrook, IL (US); Bryan J. Hillman, Peoria, IL (US); Peter Spring, Reutigen (CH); Lawrence J. Tognetti, Peoria, IL (US); Pengfei Ma, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 290 days.

(21) Appl. No.: 13/718,938

(22) Filed: Dec. 18, 2012

(65) Prior Publication Data

US 2014/0060025 A1 Mar. 6, 2014

Related U.S. Application Data

(60) Provisional application No. 61/695,688, filed on Aug. 31, 2012.

(51) Int. Cl.
*F15B 13/04* (2006.01)
*F15B 21/08* (2006.01)
(Continued)

(52) U.S. Cl.
CPC ..... *F15B 21/08* (2013.01); *E02F 9/2203* (2013.01); *E02F 9/2292* (2013.01);
(Continued)

(58) Field of Classification Search
CPC ..... F15B 13/0442; F15B 2013/0409; F15B 21/087; F15B 2211/634; F15B 2211/6346
See application file for complete search history.

(56) References Cited

U.S. PATENT DOCUMENTS 2,470,778 A 5/1949 Lankovski et al.
4,665,697 A 5/1987 Dantlgraber
(Continued)

FOREIGN PATENT DOCUMENTS

GB 889893 9/1960
JP 56-090159 7/1981
(Continued)

OTHER PUBLICATIONS

U.S. Patent Application of Jiao Zhang et al. entitled "Hydraulic Control System Having Swing Motor Energy Recovery" filed on Dec. 18, 2012.
(Continued)

*Primary Examiner* — Thomas E Lazo
(74) *Attorney, Agent, or Firm* — Finnegan, Henderson, Farabow, Garrett & Dunner, LLP

(57) ABSTRACT

A hydraulic control system is disclosed for use with a machine. The hydraulic control system may have a tank, a pump, an actuator, and a control valve configured to direct fluid from the pump to the actuator and from the actuator to the tank. The hydraulic control system may also have a pressure sensor to generate a first signal indicative of a pressure differential across the control valve, an operator input device to generate a second signal indicative of a desired movement of the actuator, and a controller. The controller may be configured to make a first determination of an opening amount of the control valve based on the second signal, and to make a second determination based on the first signal of whether the opening amount will result in overspeeding of the actuator. The controller may also be configured to reduce the opening amount based on the second determination.

20 Claims, 4 Drawing Sheets

(51) Int. Cl.
*E02F 9/22* (2006.01)
*F15B 11/17* (2006.01)

(52) U.S. Cl.
CPC ..... *E02F 9/2296* (2013.01); *F15B 11/17* (2013.01); *F15B 2211/20546* (2013.01); *F15B 2211/20576* (2013.01); *F15B 2211/30575* (2013.01); *F15B 2211/30595* (2013.01); *F15B 2211/327* (2013.01); *F15B 2211/6306* (2013.01); *F15B 2211/6309* (2013.01); *F15B 2211/6346* (2013.01); *F15B 2211/6654* (2013.01); *F15B 2211/7135* (2013.01); *F15B 2211/7142* (2013.01); *F15B 2211/75* (2013.01); *F15B 2211/86* (2013.01)

(56) References Cited

U.S. PATENT DOCUMENTS

| | | | | |
|---|---|---|---|---|
| 4,757,685 | A | 7/1988 | Burckhartzmeyer | |
| 5,067,321 | A | 11/1991 | Miyaoka | |
| 5,197,864 | A | 3/1993 | Lunzman et al. | |
| 5,575,148 | A | 11/1996 | Hirata et al. | |
| 5,622,226 | A | 4/1997 | Hausman et al. | |
| 5,630,316 | A | 5/1997 | Itsuji et al. | |
| 5,630,317 | A * | 5/1997 | Takamura et al. | 60/445 |
| 5,692,377 | A | 12/1997 | Moriya et al. | |
| 5,955,706 | A | 9/1999 | Fonkalsrud et al. | |
| 6,009,708 | A | 1/2000 | Miki et al. | |
| 6,058,343 | A | 5/2000 | Orbach et al. | |
| 6,094,911 | A | 8/2000 | Crawshaw | |
| 6,151,894 | A | 11/2000 | Endo et al. | |
| 6,209,321 | B1 * | 4/2001 | Ikari | 60/422 |
| 6,275,757 | B1 | 8/2001 | Watanabe et al. | |
| 6,393,838 | B1 | 5/2002 | Moriya et al. | |
| 6,662,705 | B2 * | 12/2003 | Huang et al. | 60/459 |
| 6,705,079 | B1 | 3/2004 | Tabor et al. | |
| 6,892,102 | B1 | 5/2005 | Fushimi | |
| 6,981,371 | B2 | 1/2006 | Imanishi et al. | |
| 7,059,125 | B2 | 6/2006 | Oka et al. | |
| 7,059,126 | B2 | 6/2006 | Ma | |
| 7,121,189 | B2 | 10/2006 | Vonderwell et al. | |
| 7,124,576 | B2 | 10/2006 | Cherney et al. | |
| 7,165,950 | B2 | 1/2007 | Fenny et al. | |
| 7,260,931 | B2 * | 8/2007 | Egelja et al. | 60/422 |
| 7,296,404 | B2 * | 11/2007 | Pfaff | 60/469 |
| 7,392,653 | B2 | 7/2008 | Sugano | |
| 7,487,707 | B2 | 2/2009 | Pfaff et al. | |
| 7,596,893 | B2 | 10/2009 | Tozawa et al. | |
| 7,748,279 | B2 | 7/2010 | Budde et al. | |
| 7,823,379 | B2 | 11/2010 | Hamkins et al. | |
| 7,908,852 | B2 | 3/2011 | Zhang et al. | |
| 7,934,329 | B2 | 5/2011 | Mintah et al. | |
| 7,979,181 | B2 | 7/2011 | Clark et al. | |
| 8,020,583 | B2 | 9/2011 | Christensen et al. | |
| 2004/0055455 | A1 | 3/2004 | Tabor et al. | |
| 2005/0081518 | A1 | 4/2005 | Ma et al. | |
| 2009/0031720 | A1 | 2/2009 | Son | |
| 2009/0217653 | A1 | 9/2009 | Zhang et al. | |
| 2011/0302914 | A1 | 12/2011 | Helbling | |

FOREIGN PATENT DOCUMENTS

| | | |
|---|---|---|
| JP | 56-131802 | 10/1981 |
| JP | 60-215103 | 10/1985 |
| JP | 63-067403 | 3/1988 |
| JP | 63-167171 | 7/1988 |
| JP | 02-43419 | 2/1990 |
| JP | 03-69861 | 3/1991 |
| JP | 05-287774 | 11/1993 |
| JP | 10-103112 | 4/1998 |
| JP | 2000-213644 | 8/2000 |
| JP | 2004-125094 | 4/2004 |
| JP | 2005-003183 | 1/2005 |

OTHER PUBLICATIONS

U.S. Patent Application of Bryan J. Hillman et al. entitled "Hydraulic Control System Having Swing Motor Energy Recovery" filed on Dec. 18, 2012.

U.S. Patent Application of Rustu Cesur et al. entitled "Hydraulic Control System Having Swing Motor Energy Recovery" filed on Dec. 18, 2012.

U.S. Appl. No. 13/714,064 of Tonglin Shang et al. entitled "Hydraulic Control System Having Swing Oscillation Dampening" filed on Dec. 13, 2012.

U.S. Appl. No. 13/714,017 of Randal N. Peterson et al. entitled "Hydraulic Control System Having Over-Pressure Protection" filed on Dec. 13, 2012.

U.S. Appl. No. 13/713,988 of Rustu Cesur et al. entitled "Adaptive Work Cycle Control System" filed on Dec. 13, 2012.

U.S. Appl. No. 13/170,960 of Pengfei Ma et al. entitled "Hydraulic Control System Having Energy Recovery Kit" filed on Jun. 28, 2011.

U.S. Appl. No. 13/171,007 of Pengfei Ma et al. entitled "Hydraulic Control System Having Swing Energy Recovery" filed on Jun. 28, 2011.

U.S. Appl. No. 13/171,047 of Jiao Zhang et al. entitled "Hydraulic Control System Having Swing Motor Energy Recovery" filed on Jun. 28, 2011.

U.S. Appl. No. 13/171,110 of Jiao Zhang et al. entitled "Hydraulic Control System Having Swing Motor Energy Recovery" filed on Jun. 28, 2011.

U.S. Appl. No. 13/171,146 of Jiao Zhang et al. entitled "Energy Recovery System Having Accumulator and Variable Relief" filed on Jun. 28, 2011.

* cited by examiner

HYDRAULIC CONTROL SYSTEM HAVING ELECTRONIC FLOW LIMITING

RELATED APPLICATIONS

This application is based on and claims the benefit of priority from U.S. Provisional Application No. 61/695,688 by Rustu CESUR et al., filed Aug. 31, 2012, the contents of which are expressly incorporated herein by reference.

TECHNICAL FIELD

The present disclosure relates generally to a hydraulic control system and, more particularly, to a hydraulic control system having electronic flow limiting.

BACKGROUND

Machines such as excavators, loaders, dozers, motor graders, and other types of heavy equipment use multiple actuators supplied with hydraulic fluid from a pump on the machine to accomplish a variety of tasks. These actuators are typically velocity controlled based on an actuation position of an operator input device. For example, an operator input device such as a joystick, a pedal, or another suitable operator input device may be movable to generate a signal indicative of a desired velocity of an associated hydraulic actuator. When an operator moves the input device, the operator expects the hydraulic actuator to move at an associated predetermined velocity.

In some situations, it may be possible for a pressure of the fluid supplied to one of the actuators to exceed a desired level. These over-pressure situations can occur, for example, when a first actuator becomes heavily loaded, forcing a greater portion of the system's fluid through a second uncompensated actuator at an elevated pressure. In these situations, the second actuator can be caused to overspeed, making the second actuator difficult to control and/or damaging the second actuator.

One attempt to synchronize the respective speeds of two actuators is disclosed in U.S. Pat. No. 7,059,125 of Oka et al. that issued on Jun. 13, 2006 (the '125 patent). The '125 patent provides a hydraulic controller that regulates the discharge flow rates from two different pumps to the two actuators, such that a difference in discharge flow rates between the pumps is reduced when the difference exceeds a threshold value. In this manner, control of the two actuators may be more predictable and stable.

Although the hydraulic controller of the '125 patent may help in the synchronizing of the speeds of two different actuators on a machine, it may be less than optimal. In particular, overspeeding of a first actuator may still occur when a second actuator being supplied by a separate pump becomes heavily loaded and a disproportionate amount of the total system flow gets sent to the first actuator.

The disclosed hydraulic control system is directed to overcoming one or more of the problems set forth above and/or other problems of the prior art.

SUMMARY

One aspect of the present disclosure is directed to a hydraulic control system. The hydraulic control system may include a tank, a pump configured to draw fluid from the tank and pressurize the fluid, an actuator, and a control valve configured to selectively direct fluid from the pump to the actuator and from the actuator to the tank to move the actuator. The hydraulic control system may also include at least one pressure sensor configured to generate a first signal indicative of a pressure differential across the control valve, an operator input device movable to generate a second signal indicative of a desired movement of the actuator, and a controller in communication with the control valve, the at least one pressure sensor, and the operator input device. The controller may be configured to make a first determination of an opening amount of the control valve based on the second signal, make a second determination based on the first signal of whether the opening amount will result in overspeeding of the actuator, and selectively reduce the opening amount based on the second determination.

Another aspect of the present disclosure is directed to a method of controlling the flow of fluid in a hydraulic control system. The method may include pumping fluid from a tank and pressurizing the fluid, selectively directing the pressurized fluid to an actuator and from the actuator to the tank to move the actuator, detecting a pressure differential across the actuator, and receiving an indication of a desired movement of the actuator. The method may also include making a first determination of an opening amount of a control valve configured to control a flow of the pressurized fluid from the pump to the actuator based on the indication of the desired movement, and making a second determination of whether the opening amount of the control valve will result in overspeeding of the actuator based on the pressure differential. The method may further include selectively reducing the opening amount of the control valve based on the second determination.

DETAILED DESCRIPTION

Figure 1:
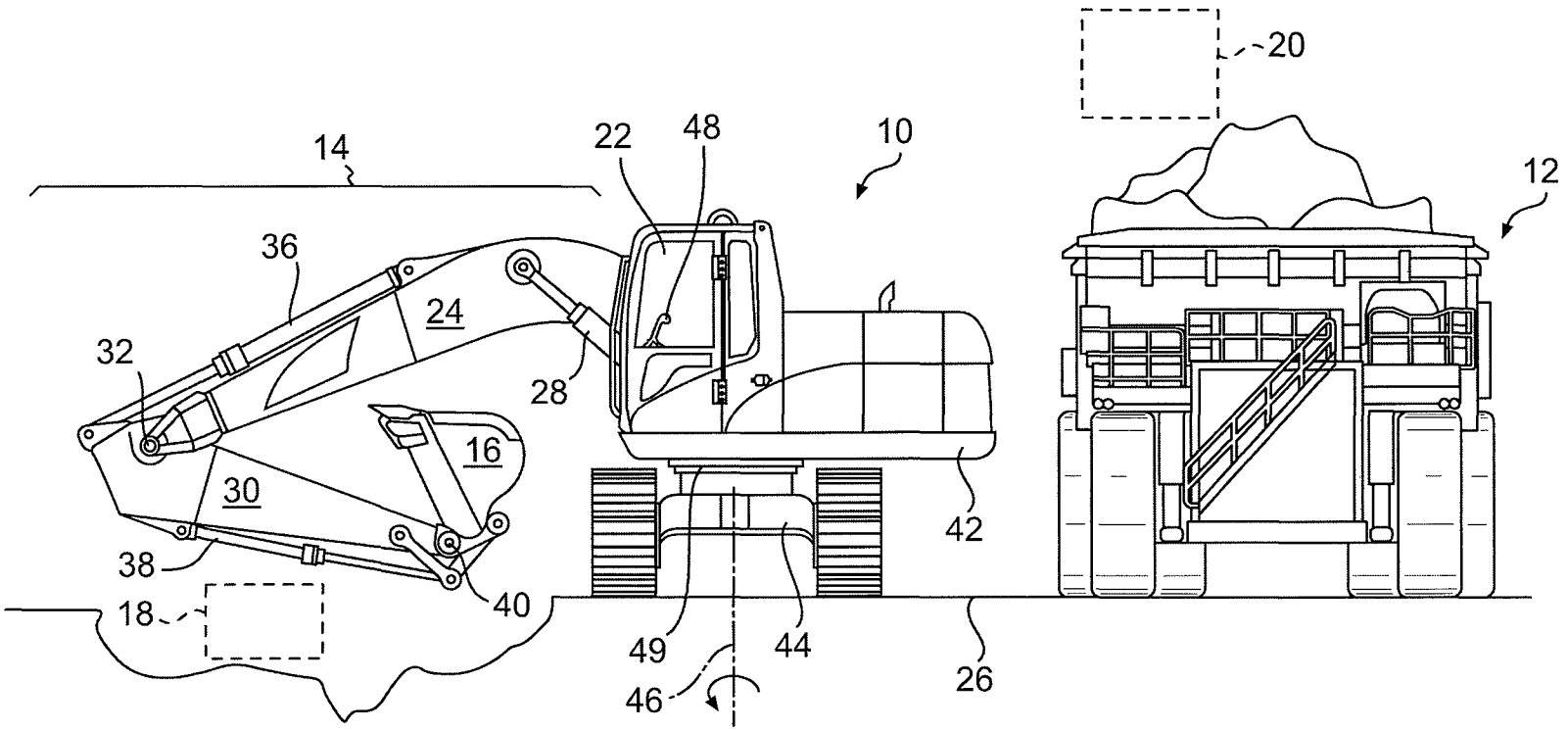
FIG. 1 is a diagrammatic illustration of an exemplary disclosed machine operating at a worksite with a haul vehicle.

FIG. 1 illustrates an exemplary machine 10 having multiple systems and components that cooperate to excavate and load earthen material onto a nearby haul vehicle 12. In the depicted example, machine 10 is a hydraulic excavator. It is contemplated, however, that machine 10 could alternatively embody another type of excavation or material handling machine, such as a backhoe, a front shovel, a motor grader, a dozer, or another similar machine. Machine 10 may include, among other things, an implement system 14 configured to move a work tool 16 between a dig location 18 within a trench or at a pile, and a dump location 20, for example over haul vehicle 12. Machine 10 may also include an operator station 22 for manual control of implement system 14. It is contemplated that machine 10 may perform operations other than truck loading, if desired, such as craning, trenching, material handling, bulk material removal, grading, dozing, etc.

Implement system 14 may include a linkage structure acted on by fluid actuators to move work tool 16. Specifically, implement system 14 may include a boom 24 that is vertically pivotal relative to a work surface 26 by a pair of adjacent, double-acting, hydraulic cylinders 28 (only one shown in FIG. 1). Implement system 14 may also include a stick 30 that is vertically pivotal about a horizontal pivot axis 32 relative to boom 24 by a single, double-acting, hydraulic cylinder 36. Implement system 14 may further include a single, double-acting, hydraulic cylinder 38 that is operatively connected to work tool 16 to tilt work tool 16 vertically about a horizontal pivot axis 40 relative to stick 30. Boom 24 may be pivotally connected to a frame 42 of machine 10, while frame 42 may be pivotally connected to an undercarriage member 44 and swung about a vertical axis 46 by a swing motor 49. Stick 30 may pivotally connect work tool 16 to boom 24 by way of pivot axes 32 and 40. It is contemplated that a different number and/or type of fluid actuators may be included within implement system 14 and connected in a manner other than described above, if desired.

Numerous different work tools 16 may be attachable to a single machine 10 and controllable via operator station 22. Work tool 16 may include any device used to perform a particular task such as, for example, a bucket, a fork arrangement, a blade, a shovel, a crusher, a shear, a grapple, a grapple bucket, a magnet, or any other task-performing device known in the art. Although connected in the embodiment of FIG. 1 to lift, swing, and tilt relative to machine 10, work tool 16 may alternatively or additionally rotate, slide, extend, open and close, or move in another manner known in the art.

Operator station 22 may be configured to receive input from a machine operator indicative of a desired work tool movement. Specifically, operator station 22 may include one or more input devices 48 embodied, for example, as single or multi-axis joysticks located proximal an operator seat (not shown). Input devices 48 may be proportional-type controllers configured to position and/or orient work tool 16 by producing work tool position signals that are indicative of a desired work tool speed and/or force in a particular direction. The position signals may be used to actuate any one or more of hydraulic cylinders 28, 36, 38 and/or swing motor 49. It is contemplated that different input devices may alternatively or additionally be included within operator station 22 such as, for example, wheels, knobs, push-pull devices, switches, pedals, and other operator input devices known in the art.

Figure 2:
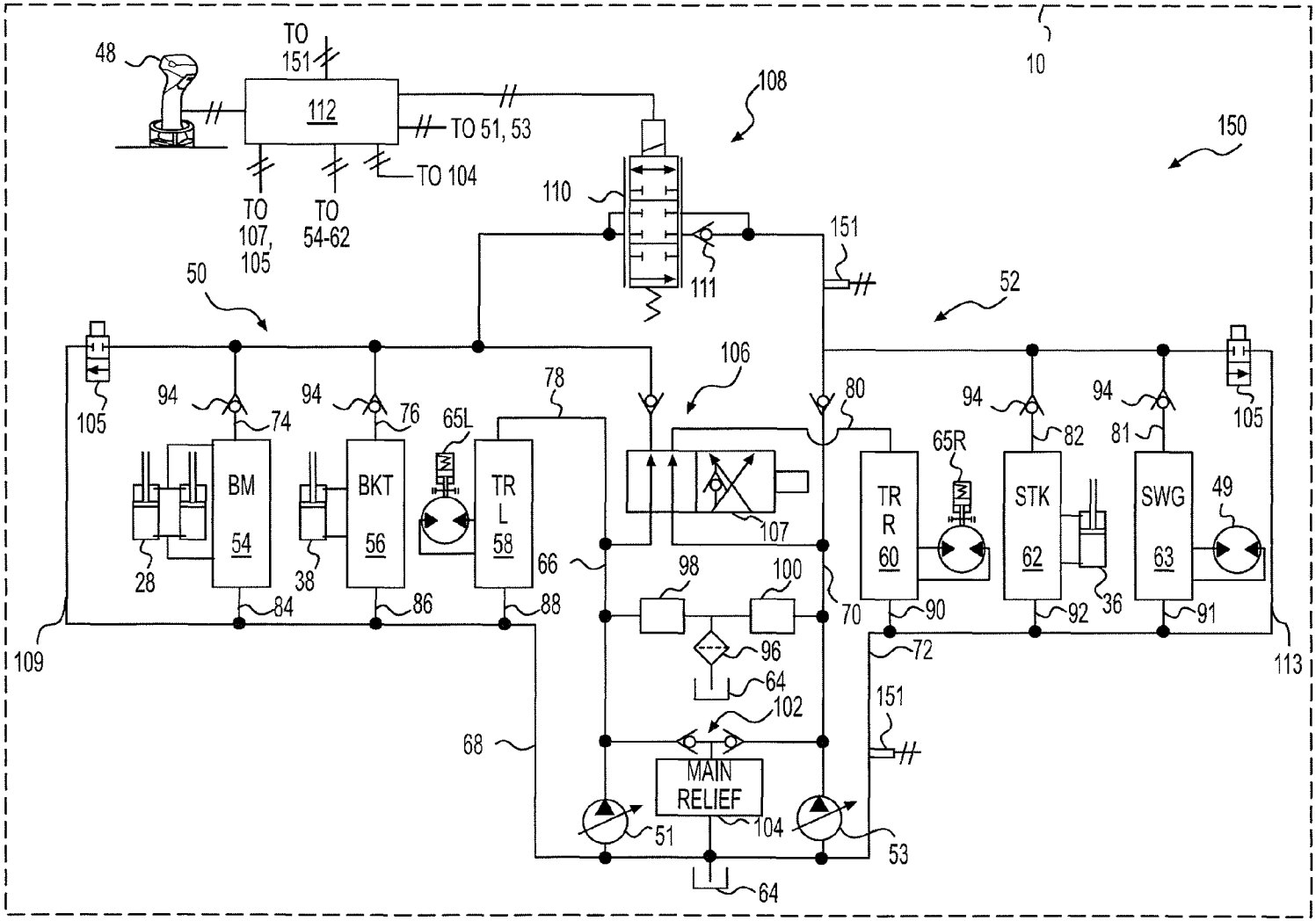
FIG. 2 is a schematic illustration of an exemplary disclosed hydraulic control system that may be used with the machine of FIG. 1.

As illustrated in FIG. 2, machine 10 may include a hydraulic control system 150 having a plurality of fluid components that cooperate to move work tool 16 (referring to FIG. 1) and machine 10. In particular, hydraulic control system 150 may include a first circuit 50 configured to receive a first stream of pressurized fluid from a first source 51, and a second circuit 52 configured to receive a second stream of pressurized fluid from a second source 53. First circuit 50 may include a boom control valve 54, a bucket control valve 56, and a left travel control valve 58 connected to receive the first stream of pressurized fluid in parallel. Second circuit 52 may include a right travel control valve 60, a stick control valve 62, and a swing control valve 63 connected in parallel to receive the second stream of pressurized fluid. It is contemplated that additional control valve mechanisms may be included within first and/or second circuits 50, 52 such as, for example, one or more attachment control valves and other suitable control valve mechanisms.

First and second sources 51, 53 may draw fluid from one or more tanks 64 and pressurize the fluid to predetermined levels. Specifically, each of first and second sources 51, 53 may embody a pumping mechanism such as, for example, a variable displacement pump (shown in FIG. 2), a fixed displacement pump, or another source known in the art. First and second sources 51, 53 may each be separately and drivably connected to a power source (not shown) of machine 10 by, for example, a countershaft (not shown), a belt (not shown), an electrical circuit (not shown), or in any other suitable manner. Alternatively, each of first and second sources 51, 53 may be indirectly connected to the power source via a torque converter, a reduction gear box, or in another suitable manner. First source 51 may produce the first stream of pressurized fluid independent of the second stream of pressurized fluid produced by second source 53. The first and second streams of pressurized fluids may be at different pressure levels and/or flow rates.

Tank 64 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 64. It is contemplated that hydraulic control system 150 may be connected to multiple separate fluid tanks or to a single tank.

Each of boom, bucket, left travel, right travel, stick, and swing control valves 54-63 may regulate the motion of their related fluid actuators. Specifically, boom control valve 54 may have elements movable to control the motion of hydraulic cylinders 28 associated with boom 24; bucket control valve 56 may have elements movable to control the motion of hydraulic cylinder 38 associated with work tool 16; and stick control valve 62 may have elements movable to control the motion of hydraulic cylinder 36 associated with stick 30. Likewise, left and right travel control valve 58, 60 may have valve elements movable to control the motion of left and right travel motors 65L, 65R (shown only in FIG. 2); and swing control valve 63 may have elements movable to control the swinging motion of swing motor 49.

The control valves of first and second circuits 50, 52 may be connected to allow pressurized fluid to flow into and drain from their respective actuators via common passageways. Specifically, the control valves of first circuit 50 may be connected to first source 51 by way of a first common supply passageway 66, and to tank 64 by way of a first common drain passageway 68. The control valves of second circuit 52 may be connected to second source 53 by way of a second common supply passageway 70, and to tank 64 by way of a second common drain passageway 72. Boom, bucket, and left travel control valves 54-58 may be connected in parallel to first common supply passageway 66 by way of individual fluid passageways 74, 76, and 78, respectively, and in parallel to first common drain passageway 68 by way of individual fluid passageways 84, 86, and 88, respectively. Similarly, right travel, stick, and swing control valves 60, 62, 63 may be connected in parallel to second common supply passageway 70 by way of individual fluid passageways 80, 82, and 81 respectively, and in parallel to second common drain passageway 72 by way of individual fluid passageways 90, 92, and 91, respectively. A check valve 94 may be disposed within each of fluid passageways 74, 76, 82, and 81 to provide for unidirectional supply of pressurized fluid to control valves 54, 56, 62, and 63, respectively.

Figure 3:
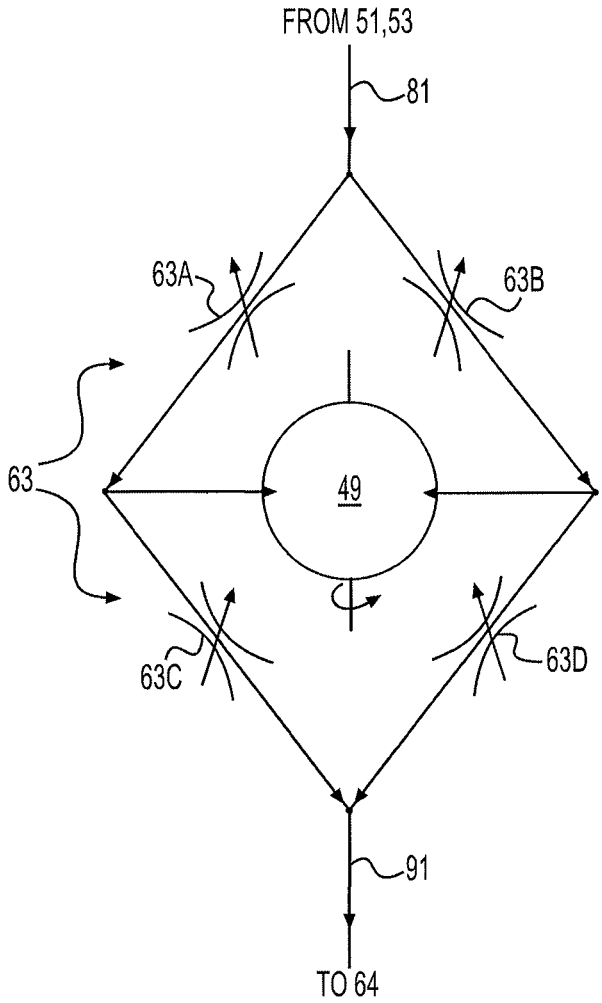
FIG. 3 is a schematic illustration of an exemplary disclosed control valve that may be used in conjunction with the hydraulic control system of FIG. 2.

Because the elements of boom, bucket, left travel, right travel, stick, and swing control valves 54-63 may be similar and function in a related manner, only the operation of swing control valve 63 will be discussed in this disclosure. As shown in FIG. 3, swing control valve 63 may include a first chamber supply element 63A, a first chamber drain element 63C, a second chamber supply element 63B, and a second chamber drain element 63D. First and second chamber supply elements 63A, 63B may be connected in parallel with fluid passageway 81 to fill their respective chambers with fluid from second source 53, while first and second chamber drain elements 63C, 63D may be connected in parallel with fluid passageway 91 to drain the respective chambers of fluid. To rotate swing motor 49 in a first direction, first chamber supply element 63A may be moved to allow the pressurized fluid from second source 53 to fill the first chamber of swing motor 49 with pressurized fluid via fluid passageway 81, while second chamber drain element 63D may be moved to drain fluid from the second chamber of swing motor 49 to tank 64 via fluid passageway 91. To rotate swing motor 49 in the opposite direction, second chamber supply element 63B may be moved to fill the second chamber of swing motor 49 with pressurized fluid, while first chamber drain element 63C may be moved to drain fluid from the first chamber of swing motor 49. It is contemplated that both the supply and drain functions may alternatively be performed by a single element associated with the first chamber and a single element associated with the second chamber, or by a single element that controls all filling and draining functions associated with swing motor 49.

The supply and drain elements of each control valve may be solenoid movable against a spring bias in response to a command. In particular, hydraulic cylinders 28, 36, 38, left and right travel motors 65L, 65R, and swing motor 49 may move at velocities that correspond to the flow rates of fluid into and out of the first and second chambers and with forces that correspond with pressure differentials between the chambers. To achieve the operator-desired velocity indicated via the input device position signal, a command based on an assumed or measured pressure may be sent to the solenoids (not shown) of the supply and drain elements that causes them to open an amount corresponding to the necessary flow rate. The command may be in the form of a flow rate command or a valve element position command.

The common supply and drain passageways of first and second circuits 50, 52 (referring back to FIG. 3) may be interconnected for makeup and relief functions. In particular, first and second common supply passageways 66, 70 may receive makeup fluid from tank 64 by way of a common filter 96 and first and second bypass elements 98, 100, respectively. As the pressure of the first or second streams of pressurized fluid drops below a predetermined level, fluid from tank 64 may be allowed to flow into first and second circuits 50, 52 by way of common filter 96 and first or second bypass elements 98, 100, respectively. In addition, first and second common drain passageways 68, 72 may relieve fluid from first and second circuits 50, 52 to tank 64. In particular, as fluid within first or second circuits 50, 52 exceeds a predetermined pressure level, fluid from the circuit having the excessive pressure may drain to tank 64 by way of a shuttle valve 102 and a common main relief element 104.

A straight travel valve 106 may selectively rearrange left and right travel control valves 58, 60 into a parallel relationship with each other. In particular, straight travel valve 106 may include a valve element 107 movable from a neutral position toward a straight travel position. When valve element 107 is in the neutral position, left and right travel control valves 58, 60 may be independently supplied with pressurized fluid from first and second sources 51, 53, respectively, to control the left and right travel motors 65L, 65R separately. When valve element 107 is in the straight travel position, however, left and right travel control valves 58, 60 may be connected in parallel to receive pressurized fluid from only first source 51 for dependent movement. The dependent movement of left and right travel motors 65L, 65R may function to provide substantially equal rotational speeds of opposing tracks, thereby propelling machine 10 in a straight direction.

When valve element 107 of straight travel valve 106 is moved to the straight travel position, fluid from second source 53 may be substantially simultaneously directed via valve element 107 through both first and second circuits 50, 52 to drive hydraulic cylinders 28, 36, 38. The second stream of pressurized fluid from second source 53 may be directed to hydraulic cylinders 28, 36, 38 of both first and second circuits 50, 52 because all of the first stream of pressurized fluid from first source 51 may be nearly completely consumed by left and right travel motors 65L, 65R during straight travel of machine 10. It should be appreciated that hydraulic control system 150 may alternatively be arranged in a complimentary manner, with respect to straight travel valve 106, such that when valve element 107 is in the straight travel position, left and right travel control valves 58, 60 may be connected in parallel to receive pressurized fluid from only second source 53, while fluid from first source 51 may be substantially simultaneously directed via valve element 107 through both first and second circuits 50, 52 to boom, bucket, stick, and swing control valves 54, 56, 62, 63.

A combiner valve 108 may selectively combine the first and second streams of pressurized fluid from first and second common supply passageways 66, 70 for high speed movement of one or more fluid actuators. In particular, combiner valve 108 may include a valve element 110 movable between a unidirectional open or flow-passing position (lower position shown in FIG. 2), a closed or flow-blocking position (middle position), and a bidirectional open or flow-passing position (upper position). When in the unidirectional open position, fluid from first circuit 50 may be allowed to flow into second circuit 52 (e.g., through a check valve 111) in response to the pressure of first circuit 50 being greater than the pressure within second circuit 52 by a predetermined amount. The predetermined amount may be related to a spring bias of check valve 111 and fixed during a manufacturing process. In this manner, when a right travel, stick, and/or swing function requires a rate of fluid flow greater than an output capacity of second source 53, and the pressure within second circuit 52 begins to drop, fluid from first source 51 may be diverted to second circuit 52 by way of valve element 110. Although shown downstream of combiner valve 108, it should be appreciated that check valve 111 may alternatively be included upstream of combiner valve 108 or within combiner valve 108, as desired. When in the closed position, substantially all flow through combiner valve 108 may be blocked. When in the bidirectional open position, however, the first stream of pressurized fluid may be allowed to flow to second circuit 52 to combine with the second stream of pressurized fluid directed to control valves 60-63, or the second stream of pressurized fluid may be allowed to flow to first circuit 50 to combine with the first stream of pressurized fluid directed to control valves 54-58, depending on a pressure differential across combiner valve 108.

Combiner valve 108 may be modulated continuously to any position between the unidirectional open, closed, and bidirectional open positions. In this manner, a degree of the flow of pressurized fluid may be controlled based on, for example, the commanded velocities of control valves 54-63, the commanded flow rates of sources 51, 53, and/or the pressure differential across combiner valve 108. For example, valve element 110 may be solenoid movable to any position between the flow-passing positions and the flow-blocking position in response to a current command.

In one embodiment, hydraulic control system 150 may also include a warm-up circuit. That is, the common supply and drain passageways 66, 68 and 70, 72 of first and second circuits 50, 52, respectively, may be selectively communicated via first and second bypass passageways 109, 113 for warm-up and/or other bypass functions. A bypass valve 105 may be located in each of bypass passageways 109, 113 and configured to direct fluid from common supply passageways 66 and 70 to common drain passageways 68 and 72, respectively. Each bypass valve 105 may include a valve element movable from a closed or flow-blocking position to an open or flow-passing position. In this configuration, when bypass valve 105 is in the open position, such as during start up of machine 10, fluid pressurized by first and second sources 51, 53 may be allowed to circulate through first and second circuits 50, 52 with very little restriction (i.e., without passing through control valves 54-62). After warm-up, the valve elements of bypass valves 105 may be moved to the closed positions so that the pressure of the fluid in first and second circuits 50, 52 may build and be available for control valves 54-62, as described above. It is contemplated that bypass passageways 109, 113 and bypass valves 105 may be omitted, if desired.

Hydraulic control system 150 may also include a controller 112 in communication with operator input device 48, first and/or second sources 51, 53, combiner valve 108, the supply and drain elements of control valves 54-62, and bypass valves 105. It is contemplated that controller 112 may also be in communication with other components of hydraulic control system 150 such as, for example, common main relief element 104, first and second bypass elements 98, 100, straight travel valve 106, and other such components of hydraulic control system 150. Controller 112 may embody a single microprocessor or multiple microprocessors that include a means for controlling an operation of hydraulic control system 150. Numerous commercially available microprocessors can be configured to perform the functions of controller 112. It should be appreciated that controller 112 could readily be embodied in a general machine microprocessor capable of controlling numerous machine functions. Controller 112 may include a memory, a secondary storage device, a processor, and any other components for running an application. Various other circuits may be associated with controller 112 such as power supply circuitry, signal conditioning circuitry, solenoid driver circuitry, and other types of circuitry.

One or more maps relating the input device position signal, desired actuator velocity, associated flow rates, measured pressures or pressure differentials, and/or valve element position, for hydraulic cylinders 28, 36, 38; left and right travel motors 65L, 65R; and/or swing motor 49 may be stored in the memory of controller 112. Each of these maps may include a collection of data in the form of tables, graphs, and/or equations. In one example, desired velocity and commanded flow rate may form the coordinate axis of a 2-D table for control of the first and second chamber supply elements. The commanded flow rate required to move the fluid actuators at the desired velocity and the corresponding valve element position of the appropriate supply element may be related in another separate 2-D map or together with desired velocity in a single 3-D map. It is also contemplated that desired actuator velocity may be directly related to the valve element position in a single 2-D map. Controller 112 may be configured to allow the operator to directly modify these maps and/or to select specific maps from available relationship maps stored in the memory of controller 112 to affect fluid actuator motion. It is contemplated that the maps may additionally or alternatively be automatically selectable based on modes of machine operation.

Controller 112 may be configured to receive input from operator input device 48 and to command operation of control valves 54-63 in response to the input and the relationship maps described above. Specifically, controller 112 may receive the input device position signal indicative of a desired velocity and reference the selected and/or modified relationship maps stored in the memory of controller 112 to determine flow rate values and/or associated positions for each of the supply and drain elements within control valves 54-63. The flow rates or positions may then be commanded of the appropriate supply and drain elements to cause filling of the first or second chambers at a rate that results in the desired work tool velocity.

Controller 112 may be configured to affect operation of combiner valve 108 in response to, for example, the commanded velocities of control valves 54-63, the commanded flow rates of sources 51, 53, and/or the pressure differential across combiner valve 108. That is, if the determined flow rates associated with the desired velocities of particular fluid actuators meet predetermined criteria, controller 112 may cause valve element 110 to move toward the unidirectional flow-passing position to supply additional pressurized fluid to second circuit 52, cause valve element 110 to move toward the bidirectional flow-passing position to supply additional pressurized fluid to first circuit 50 and/or second circuit 52, or inhibit valve element 110 from moving out of the closed position.

Figure 4:
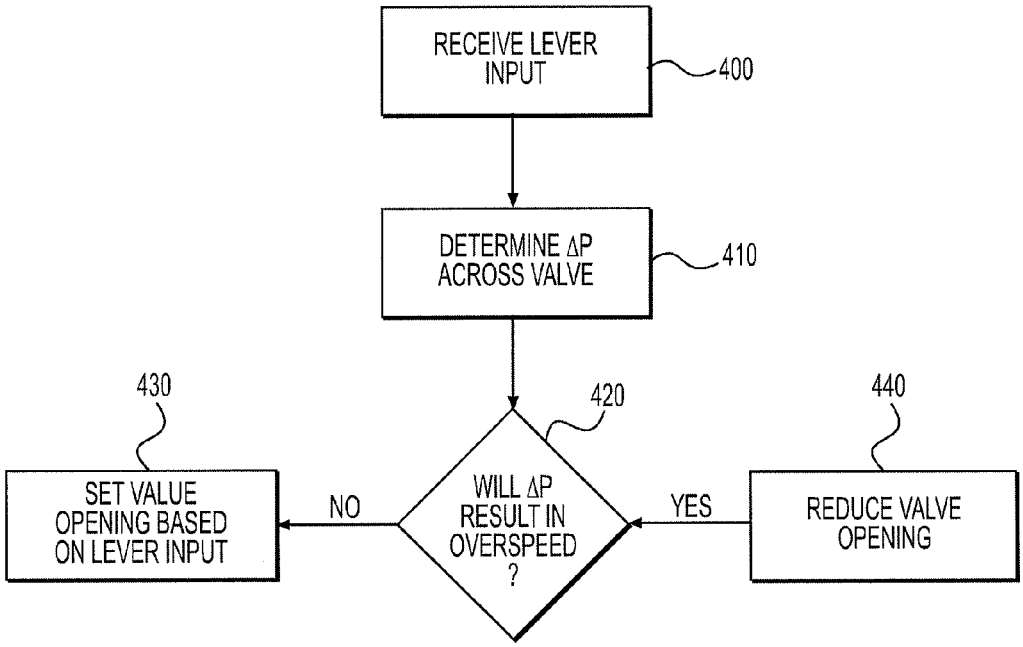
FIG. 4 is a flowchart depicting an exemplary disclosed process that may be performed by the hydraulic control system of FIG. 2.

In some situations, it may be possible for too much fluid and/or for fluid with too high of a pressure to be directed to a single actuator of hydraulic control system 150. For example, during an operation where boom control valve 54 is passing fluid to hydraulic cylinders 28, where swing control valve 63 is passing fluid to swing motor 49, where combiner valve 108 is in the one of its flow-combining positions, and work took 16 is suddenly loaded, the pressure of first circuit 50 could dramatically increase. This increase in pressure could cause a greater amount of fluid at an elevated pressure to pass through combiner valve 108 into second circuit 52. Unless accounted for, this sudden increase of high-pressure fluid within second circuit 52 could cause a corresponding increase in flow rate of fluid through swing control valve 63 and swing motor 49, causing a sudden speed and/or force increase in the swinging movement of machine 10. Controller 112 may be configured to monitor pressure changes within hydraulic control system 150, for example by way of one or more pressure sensors 151, and affect operation of swing control valve 63 to protect swing motor 49 from overspeeding in this situation. FIG. 4 is a flowchart depicting this control process. FIG. 4 will be discussed in more detail in the following section to further illustrate the disclosed concepts.

In the disclosed embodiment, two pressure sensors 151 are shown. In particular, a first pressure sensor 151 is located to sense a pressure of common supply passage 70, while a second pressure sensor 151 is located to sense a pressure of common drain passage 72. In this manner, controller 112 may be configured to calculate a pressure differential across swing control valve 63 based on signals from the first and second pressure sensors 151. It is contemplated, however, that a different number of pressure sensors may be utilized and/or placed at different locations within hydraulic control system 150, if desired.

INDUSTRIAL APPLICABILITY

The disclosed hydraulic control system may be applicable to any machine that hydraulically moves a work tool. The disclosed hydraulic control system may help to reduce overspeeding of work tool actuators that occur during movement of the work tool through electronic flow limiting of actuator valves. Operation of the disclosed hydraulic control system will now be described in detail with reference to FIG. 4.

As the operator of machine 10 manipulates input device 48, a demand for a particular swinging movement of work tool 16 may be created. Controller 112 may be configured to receive input from input device 48 indicative of the demand (e.g., lever input) (Step 400), and also receive signals from sensors 151 indicative of pressures within hydraulic control system 150 (e.g., a pressure differential across swing control valve 63) (Step 410). Conventionally, controller 112 would then set the positions of the elements of swing control valve 63 to particular opening amounts based on the input from input device 48 and, in some situations, also based on an assumed or calculated available flow capacity of the associated fluid source. However, in some situations (as described above), doing so could cause swing motor 49 to overspeed.

Accordingly, controller 112 may first determine if the current pressure differential across swing control valve 63 (as calculated based on signals from sensors 151), in combination with the particular valve opening amounts, will result in overspeeding of swing motor 49 (Step 420). This determination may be made by referencing the opening amounts determined in the conventional manner and the pressure differential with one or more maps stored in memory. When the particular opening amounts will not result in overspeeding of swing motor 49 for the given pressure differential, controller 112 may be configured to set the opening amounts in the conventional manner (i.e., based on the lever input from input device 48 and/or the assumed or calculated available flow capacity) (Step 430). In some embodiments, controller 112 may even be able to selectively increase the opening amounts based on the determination, as long as doing so will not result in overspeeding. For example, controller 112 may be configured to increase the opening amounts for the given pressure differential up to a maximum flow rate limit associated with a speed threshold of swing motor 49 and/or to a maximum available capacity of first and/or second sources 51, 53 (as long as the maximum available capacity is less than the maximum flow rate limit). When, however, the conventionally determined opening amounts will result in overspeeding of swing motor 49, controller 112 may be configured to reduce the opening amounts (Step 440). This reduction may electronically limit the flow rate of fluid through and resulting speed of swing motor 49 to an acceptable and non-damaging level. Controller 112 may reference one or more maps stored in memory to determine the acceptable and non-damaging level as well as control parameters that should be used to ensure these levels are not exceeded.

When controller 112 sets the opening amounts of the valve elements within swing control valve 63 based on input from input device 48 and/or the assumed or calculated available flow capacity (i.e., without reference to the pressure differential), the swinging speed of machine 10 may be able to fluctuate somewhat. That is, swing control valve 63 may be allowed to operate as an open-center type of valve that passes a varying rate of fluid through swing motor 49 based on the fluctuating pressure differential across swing control valve 63. In some instances, for example when combiner valve 108 is not passing fluid and no other functions (e.g., right travel, stick, etc.) are being performed, the pressure across swing control valve 63 may fluctuate little and the resulting speed of swing motor 49 may be fairly steady and at a level expected by the operator. In other situations, however, fluctuations in the pressure within second circuit 52 may allow for an increase in swinging speed of swing motor 49, which may be desirable in some situations. In no situation, however, will controller 112 allow the speed of swing motor 49 to exceed a maximum threshold associated with uncontrolled movements and/or damage of swing motor 49.

It is contemplated that the above-described operation can be selectively overridden by the operator, if desired. In particular, there may be times when the operator desires the swing speed of swing motor 49 to be directly related to lever input (i.e., to the input received via input device 48), even when pressures within second circuit 52 fluctuate within the maximum limit. In this situation, the operator may be able to request that controller 112 always adjust the opening amounts of the valve elements within swing control valve 63 based on the lever input and the pressure differential, such that a controlled flow rate of fluid always passes through swing motor 49.

Several benefits may be associated with the disclosed hydraulic control system. First, hydraulic control system 150 may be prevented from damaging overspeed conditions, even when pressure fluctuations within the system occur. Second, the operator may be provided with different selectable modes of operation. For example, the operator may be able to select a first mode wherein actuator speeds are allowed to fluctuate some (but still not exceed a maximum threshold), or a second mode where actuator speeds are precisely controlled. The first mode may allow for increased efficiency and/or productivity, as unnecessary restrictions are not placed on pressurized flows of fluid and a full capacity of machine 10 may be utilized. The second mode may allow for greater control over machine movements.

It will be apparent to those skilled in the art that various modifications and variations can be made to the disclosed hydraulic control system. Other embodiments will be apparent to those skilled in the art from consideration of the specification and practice of the disclosed hydraulic control system. For example, although electronic flow limiting has been described with respect to only the swinging motions of machine 10, it is contemplated that other motions (e.g., boom lifting, stick pivoting, work tool tilting, travel motor rotation, etc.) could likewise be controlled. It is intended that the specification and examples be considered as exemplary only, with a true scope being indicated by the following claims and their equivalents.

What is claimed is:

1. A hydraulic control system, comprising:

a tank;

a pump configured to draw fluid from the tank and pressurize the fluid;

an actuator;

a control valve configured to selectively direct fluid from the pump to the actuator and from the actuator to the tank to move the actuator;

at least one pressure sensor configured to generate a first signal indicative of a pressure differential across the control valve;

an operator input device movable to generate a second signal indicative of a desired movement of the actuator; and a controller in communication with the control valve, the at least one pressure sensor, and the operator input device, the controller being configured to:

make a first determination of an opening amount of the control valve based on the second signal;

make a second determination based on the first signal of whether the opening amount will result in overspeeding of the actuator; and selectively reduce the opening amount based on the second determination.

2. The hydraulic control system of claim 1, wherein the controller is further configured to selectively increase the opening amount of the control valve based on the second determination when the increase will not result in overspeeding of the actuator.

3. The hydraulic control system of claim 2, wherein the controller is configured to selectively increase the opening amount of the control valve to an increased opening amount that results in consumption of an available flow of pressurized fluid or a maximum speed of the actuator.

4. The hydraulic control system of claim 1, wherein the controller is further configured to adjust the opening amount of the control valve based on the first signal during operation in an overriding control mode selectable by an operator even when the opening amount of the control valve will not result in overspeeding of the actuator.

5. The hydraulic control system of claim 1, wherein:
the actuator is a first actuator;
the hydraulic control system further includes a second actuator configured to receive fluid from the pump; and
loading on the second actuator affects the pressure differential across the control valve.

6. The hydraulic control system of claim 5, wherein:
the pump is a first pump; and
the hydraulic control system further includes a second pump connected to selectively supply fluid to both the first and second actuators 7. The hydraulic control system of claim 6, further including a combiner valve configured to selectively combine fluid flows from the first and second pumps and direct combined fluid flows to the first actuator.

8. The hydraulic control system of claim 7, wherein the combiner valve is configured to selectively enable one or more of unidirectional flow from one of the first and second supply passageways to the other of the first and second supply passageways, bidirectional flow between the first and second supply passageways, and no flow between the first and second supply passageways.

9. The hydraulic control system of claim 5, wherein:
the first actuator is a swing motor; and
the second actuator is a boom cylinder.

10. The hydraulic control system of claim 1, wherein the controller is configured to selectively reduce the opening amount based on the second determination to a reduced opening amount such that the pressure differential across the control valve in combination with the reduced opening amount will result in a maximum allowable speed of the actuator.

11. The hydraulic control system of claim 1, wherein the controller is further configured to reference the opening amount of the control valve and the pressure differential across the control valve with one or more maps stored in memory when making the second determination.

12. A method of controlling fluid flow, comprising:
drawing fluid from a tank and pressurizing the fluid with a pump;
selectively directing pressurized fluid through a control valve to an actuator and from the actuator through the control valve to the tank to move the actuator;
detecting a pressure differential across the control valve;
receiving an indication of a desired movement of the actuator;
making a first determination of an opening amount of the control valve based on the indication of the desired movement;
making a second determination of whether the opening amount of the control valve will result in overspeeding of the actuator based on the pressure differential; and
selectively reducing the opening amount of the control valve based on the second determination.

13. The method of claim 12, further including selectively increasing the opening amount of the control valve based on the second determination when increasing will not result in overspeeding of the actuator.

14. The method of claim 13, wherein increasing includes increasing the opening amount of the control valve to an increased opening amount that results in consumption of an available flow of pressurized fluid or a maximum speed of the actuator.

15. The method of claim 12, further including adjusting the opening amount of the control valve based on the pressure differential during operation in an overriding control mode selectable by an operator even when the opening amount of the control valve will not result in overspeeding of the actuator.

16. The method of claim 12, wherein:
the actuator is a first actuator; and
loading on a second actuator affects the pressure differential across the control valve.

17. The method of claim 16, wherein:
the pump is a first pump; and
the method further includes:
drawing fluid from the tank and pressurizing the fluid with a second pump; and
selectively combining fluid flows from the first and second pumps;
selectively directing combined fluid flows to the first and second actuators.

18. The method of claim 17, wherein selectively combining fluid flows includes selectively enabling a unidirectional flow from a second circuit associated with the second pump to a first circuit associated with the first pump; bidirectional flows between the first and second circuits, and no flow between the first and second circuits.

19. The method of claim 16, wherein:
the first actuator is a swing motor; and
the second actuator is a boom cylinder.

20. The method of claim 12, further including reducing the opening amount based on the second determination to a reduced opening amount such that the pressure differential across the control valve in combination with the reduced opening amount will result in a maximum allowable speed of the actuator.

* * * * *